US011485926B2

(12) United States Patent
Shono et al.

(10) Patent No.: US 11,485,926 B2
(45) Date of Patent: Nov. 1, 2022

(54) REFRIGERANT OIL AND METHOD FOR PRODUCING REFRIGERANT OIL

(71) Applicant: ENEOS CORPORATION, Tokyo (JP)

(72) Inventors: Yohei Shono, Tokyo (JP); Tatsuki Nakajima, Tokyo (JP); Shogo Hashimoto, Tokyo (JP); Yuya Mizutani, Tokyo (JP); Hidetoshi Ogata, Tokyo (JP)

(73) Assignee: ENEOS CORPORATION, Tokyo (JP)

( * ) Notice: Subject to any disclaimer, the term of this patent is extended or adjusted under 35 U.S.C. 154(b) by 0 days.

(21) Appl. No.: 17/423,636

(22) PCT Filed: Jan. 21, 2020

(86) PCT No.: PCT/JP2020/002004

§ 371 (c)(1),
(2) Date: Jul. 16, 2021

(87) PCT Pub. No.: WO2020/153381

PCT Pub. Date: Jul. 30, 2020

(65) Prior Publication Data

US 2022/0098507 A1 Mar. 31, 2022

(30) Foreign Application Priority Data

Jan. 23, 2019 (JP) ..... JP2019-009183

(51) Int. Cl.
*C10M 137/10* (2006.01)
*C10M 137/08* (2006.01)
(Continued)

(52) U.S. Cl.
CPC ..... *C10M 137/08* (2013.01); *C10M 107/32* (2013.01); *C10M 169/04* (2013.01);
(Continued)

(58) Field of Classification Search
CPC ..... C10M 137/08; C10M 107/32; C10M 169/04; C10M 2209/1023;
(Continued)

(56) References Cited

U.S. PATENT DOCUMENTS 5,858,266 A * 1/1999 Kaneko ..... C10M 137/02 508/435

FOREIGN PATENT DOCUMENTS

CA 2201883 4/1996
CN 101522871 9/2009
(Continued)

OTHER PUBLICATIONS

ISR issued in WIPO Patent Application No. PCT/JP2020/002004, Apr. 14, 2020, English translation.
(Continued)

*Primary Examiner* — Prem C Singh
*Assistant Examiner* — Francis C Campanell
(74) *Attorney, Agent, or Firm* — Greenblum & Bernstein, P.L.C.

(57) ABSTRACT

The present invention provides a refrigerating machine oil comprising a lubricating base oil and at least one selected from the group consisting of an amine salt of phosphonic acid and an amine salt of phosphonic acid monoester, and a method for producing the same.

9 Claims, 2 Drawing Sheets

(51) Int. Cl.

| | |
|---|---|
| ***C10M 107/32*** | (2006.01) |
| ***C10M 169/04*** | (2006.01) |
| *C10N 30/06* | (2006.01) |
| *C10N 40/30* | (2006.01) |
| *C10N 70/00* | (2006.01) |

(52) U.S. Cl.
CPC ..... *C10M 2209/1023* (2013.01); *C10M 2223/043* (2013.01); *C10N 2030/06* (2013.01); *C10N 2040/30* (2013.01); *C10N 2070/00* (2013.01)

(58) Field of Classification Search
CPC ..... C10M 2223/043; C10N 2030/06; C10N 2040/30; C10N 2070/00
USPC ..... 508/435
See application file for complete search history.

(56) References Cited

FOREIGN PATENT DOCUMENTS

| | | |
|---|---|---|
| CN | 103589486 | 2/2014 |
| CN | 104114683 | 10/2014 |
| CN | 107250330 | 10/2017 |
| EP | 0 523 561 A1 | 1/1993 |
| JP | 5-017794 | 1/1993 |
| JP | 9-025492 | 1/1997 |
| JP | 2008-266423 | 11/2008 |
| WO | 96/011246 | 4/1996 |

OTHER PUBLICATIONS

IPRP issued in WIPO Patent Application No. PCT/JP2020/002004, Aug. 5, 2021, English translation.

* cited by examiner

REFRIGERANT OIL AND METHOD FOR PRODUCING REFRIGERANT OIL

TECHNICAL FIELD

The present invention relates to a refrigerating machine oil and a method for producing a refrigerating machine oil.

BACKGROUND ART

Refrigerating machines such as refrigerators, car air-conditioners, room air-conditioners, and automatic vending machines have a compressor for circulating a refrigerant in a refrigeration cycle. Further, the compressor is charged with a refrigerating machine oil for lubricating a sliding member. Generally, the refrigerating machine oil contains a base oil and an additive that are blended according to desired properties.

For example, as additives for improving the antiwear property of refrigerating machine oils, antiwear agents such as phosphorus-based antiwear agents and sulfur-based antiwear agents are known. In Patent Literature 1, a refrigerating machine oil containing a phosphorus-based additive including a phosphoric acid triester and/or a phosphorous acid triester is disclosed.

CITATION LIST

Patent Literature

[Patent Literature 1] Japanese Unexamined Patent Publication No. 2008-266423

SUMMARY OF INVENTION

Technical Problem

However, according to the study by the present inventors, it has been found that in a case where the refrigerating machine oil using the phosphorus-based additive as described above exhibits excellent antiwear property at the initial stage, the antiwear property may decrease after long-term storage.

The present invention has been made in view of such circumstances, and aims to provide a refrigerating machine oil which is capable of maintaining excellent antiwear property for a long period of time, and a method for producing the refrigerating machine oil.

Solution to Problem

In order to solve the above problems, the present inventors first examined the effect of improving antiwear property by adding phosphonic acid diester to refrigerating machine oil. As a result, it has been found that a part of the phosphonic acid diester changes to phosphonic acid or phosphonic acid monoester, and that the produced phosphonic acid and phosphonic acid monoester contribute to the improvement of antiwear property. However, it was found that phosphonic acid and phosphonic acid monoester are chemically unstable compounds, and even if these compounds are used as they are, it is not possible to maintain the antiwear property for a long period of time.

Therefore, as a result of further studies based on the above findings, the present inventors have found that by allowing the phosphonic acid or the phosphonic acid monoester be present in the refrigerating machine oil in the form of an amine salt, it is possible to impart excellent antiwear property to the refrigerating machine oil and it is possible to maintain its antiwear property for a long period of time, thereby completing the present invention.

That is, the present invention provides a refrigerating machine oil comprising a lubricating base oil and at least one selected from the group consisting of an amine salt of phosphonic acid and an amine salt of phosphonic acid monoester.

The present invention also provides a method for producing a refrigerating machine oil, which comprises adding at least one selected from the group consisting of an amine salt of phosphonic acid and an amine salt of phosphonic acid monoester to a lubricating base oil or an oil composition containing a lubricating base oil.

The present invention further provides a method for producing a refrigerating machine oil, which comprises adding a phosphonic acid diester and an amine compound to a lubricating base oil or an oil composition containing a lubricating base oil.

Advantageous Effects of Invention

According to the present invention, it is possible to provide a refrigerating machine oil which is capable of maintaining excellent antiwear property for a long period of time, and a method for producing such a refrigerating machine oil.

DESCRIPTION OF EMBODIMENTS

Figure 1:
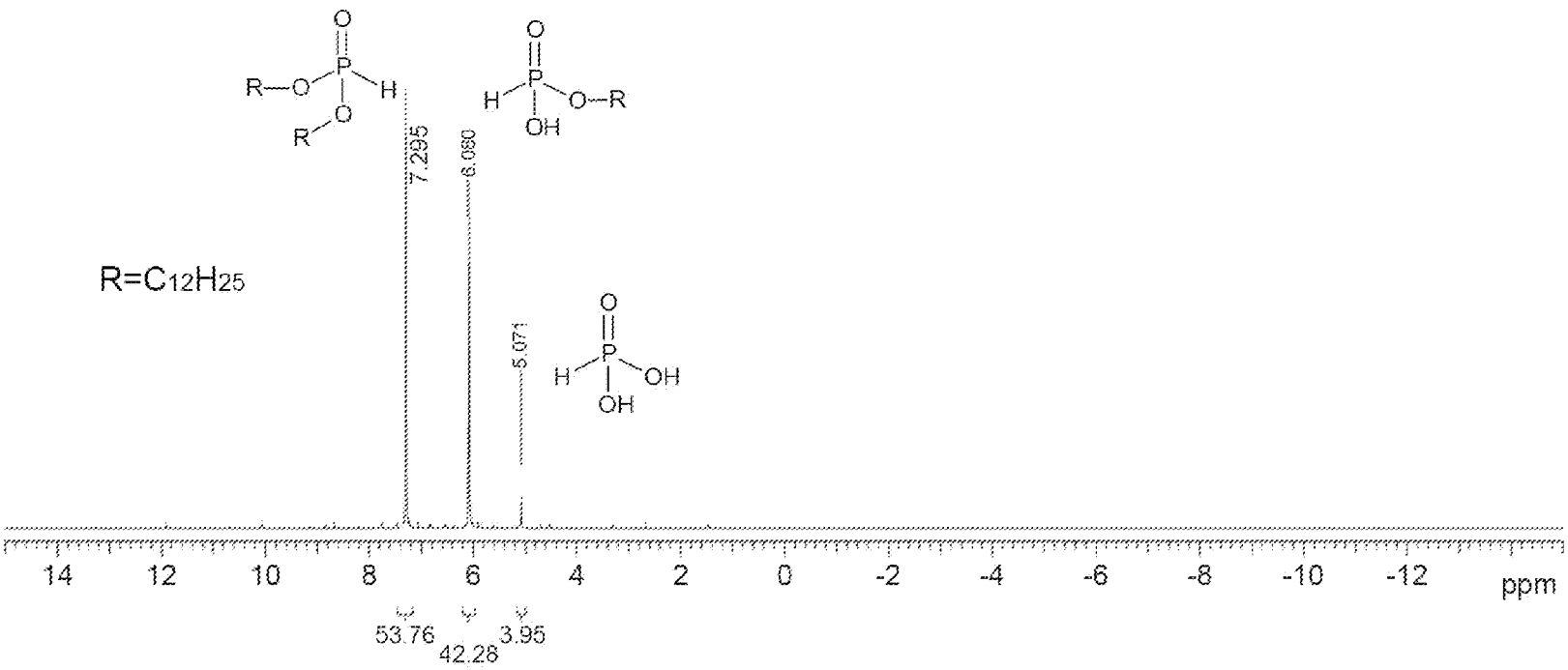
FIG. 1 is a $^{31}$P-NMR chart showing phosphonic acid and phosphonic acid monoester before amine chlorination.

Hereinafter, embodiments of the present invention will be described in detail.

A refrigerating machine oil according to the present embodiment comprises a lubricating base oil and at least one selected from the group consisting of an amine salt of phosphonic acid and an amine salt of phosphonic acid monoester (hereinafter, sometimes referred to as "amine salt in the present embodiment".

According to such refrigerating machine oil, it is possible to maintain the antiwear property for a long period of time. The present inventors infer the reason why such an effect is achieved as follows.

That is, first, since the phosphonic acid or the phosphonic acid monoester is present in the form of an amine salt during storage of the refrigerating machine oil, it is considered that it is possible to stably retain these components in the refrigerating machine oil. Then, during use of the refrigerating machine oil, a part or all of the amine compounds are separated from the amine salt to be the form of phosphonic acid or phosphonic acid monoester, and it is considered that the antiwear property improving effect of these components can be effectively exhibited.

Phosphonic acid is a compound represented by the following formula (1). The amine salt of phosphonic acid may be one in which at least one of the hydroxyl groups in the compound represented by the following formula (1) and an amine compound form an amine salt. The phosphonic acid may be present as phosphorous acid trihydroxy-type, which is a tautomer thereof.

(1)

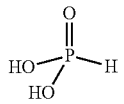

The phosphonic acid monoester may be, for example, at least one compound represented by the following formula (2). The amine salt of phosphonic acid monoester may be one in which at least one of the hydroxyl groups in the compound represented by the following formula (2) and an amine compound form an amine salt. The phosphonic acid monoester is also called to as monohydrocarbyl hydrogen phosphite, and may be present as phosphorous acid monoester of dihydroxy-type, which is a tautomer thereof.

(2)

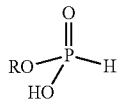

In formula (2), R represents a hydrocarbon group (hydrocarbyl group).

It is preferable for the hydrocarbon group represented by R to be a hydrocarbon group having 1 to 20 carbon atoms. Examples of this hydrocarbon group include an alkyl group, an alkenyl group, an (alkyl)cycloalkyl group, and an (alkyl) aryl group. Among them, R is preferably an alkyl or alkenyl group having 2 to 18 carbon atoms or an (alkyl)aryl group having 6 to 10 carbon atoms, and more preferably an alkyl or alkenyl group having 2 to 18 carbon atoms. Further, the alkyl group and the alkenyl group may be linear or branched.

Examples of such a phosphonic acid monoester include monooctyl hydrogen phosphite, mono(2-ethylhexyl) hydrogen phosphite, monolauryl hydrogen phosphite, monooleyl hydrogen phosphite, and monoethyl hydrogen phosphite, and monophenyl hydrogen phosphite. Among them, from the viewpoint of antiwear property, at least one selected from the group consisting of monooctyl hydrogen phosphite, mono(2-ethylhexyl) hydrogen phosphite, monolauryl hydrogen phosphite, and monooleyl hydrogen phosphite is preferable.

The amine compound is not particularly limited as long as it is a compound having an amino group in the molecule, and examples thereof include an alkyl- or alkenyl-amine having one or two alkyl or alkenyl groups having 1 to 20 carbon atoms, an alkanolamine having an alkanol group such as ethanol and propanol or a derivative thereof, and a polyamine having an alkylene group having 2 to 4 carbon atoms or a derivative thereof. Examples of the alkyl or alkenylamine include di(2-ethylhexyl)amine, oleylamine, 2-ethylhexylamine and the like, and di(2-ethylhexyl)amine is particularly preferable. Further, examples of the alkanolamine include mono, di or tridiethanolamine, mono, di or tri(iso)propanolamine, and mono, di or tri(iso)butanolamine. Among them, mono or dialkanolamine may be one that has an alkyl group or alkenyl group having 1 to 20 carbon atoms, such as 2-ethylhexyldiethanolamine, dodecyldi(iso)propanolamine, lauryldiethanolamine, and oleyldiethanolamine. Further, examples of the polyamine include ethylenediamine, diethylenetriamine, triethylenetetramine, tetraethylenehexamine and derivatives thereof. Among them, the polyamine derivative may be a reaction product of the polyamine and a fatty acid having 1 to 40 carbon atoms such as oleic acid and stearic acid or a dibasic acid such as oxalic acid, maleic acid, succinic acid, and alkyl or alkenylsuccinic acid.

The content of the amine salt in the present embodiment is preferably 0.0001 to 1% by mass, more preferably 0.001 to 0.5% by mass, and still more preferably 0.001 to 0.1% by mass, based on the total amount of refrigerating machine oil.

A method for producing a refrigerating machine oil according to the present embodiment comprises a step of adding at least one selected from the group consisting of an amine salt of phosphonic acid and an amine salt of phosphonic acid monoester to a lubricating base oil or an oil composition containing a lubricating base oil. In this production method, the amine salt in the present embodiment may be one in which phosphonic acid or phosphonic acid monoester and an amine compound have been reacted to form an amine salt, one in which a part of phosphonic acid diester has changed to phosphonic acid or phosphonic acid monoester, or one in which phosphonic acid or phosphonic acid monoester mixed with phosphonic acid diester as an impurity in relation to the purification degree has been reacted with an amine compound to form an amine salt. When changing a part of the phosphonic acid diester to phosphonic acid or phosphonic acid monoester, a solvent such as kerosene, mineral oil, normal hexane, toluene, a light solvent, benzene, xylene, alcohols, ethers, and esters may be used. Furthermore, in this case, the amine salt in the present embodiment may be added alone, or the amine salt in the present embodiment may also be added together with the phosphonic acid diester.

Further, another method for producing a refrigerating machine oil according to the present embodiment comprises a step of adding phosphonic acid diester and an amine compound to a lubricating base oil or an oil composition containing a lubricating base oil. In such a production method, in the lubricating base oil or the oil composition containing a lubricating base oil, phosphonic acid or phosphonic acid monoester in which a part of the phosphonic acid diester has been changed, or phosphonic acid or phosphonic acid monoester mixed with phosphonic acid diester as an impurity in relation to the purification degree may react with an amine compound to produce an amine salt in the present embodiment.

In addition, in the present specification, the oil composition containing a lubricating base oil is one containing, in addition to a lubricating base oil, other additives described later. In this case, the content of the lubricating base oil in the oil composition may be 50% by mass or more, may be 70% by mass or more, and may be 90% by mass or more, based on the total amount of the oil composition.

The phosphonic acid diester may be, for example, a compound represented by the following formula (3). The phosphonic acid diester is also called to as dihydrocarbyl hydrogen phosphite, and may be present as phosphorous acid diester of monohydroxy-type, which is a tautomer thereof.

(3)

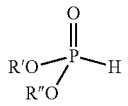

In formula (3), R' and R" may be the same or different, and each represents a hydrocarbon group (hydrocarbyl group).

It is preferable for the hydrocarbon group represented by R' and R" to be a hydrocarbon group having 1 to 20 carbon atoms. Examples of this hydrocarbon group include an alkyl group, an alkenyl group, an (alkyl)cycloalkyl group, a phenyl group, and an (alkyl)aryl group such as a cresyl group. Among them, R is preferably an alkyl group or an alkenyl group having 2 to 18 carbon atoms or an (alkyl)aryl group having 6 to 10 carbon atoms, and more preferably an alkyl group or an alkenyl group having 2 to 18 carbon atoms. Further, the alkyl group and the alkenyl group may be linear or branched.

Examples of such a phosphonic acid diester include dioctyl hydrogen phosphite, di(2-ethylhexyl) hydrogen phosphite, dilauryl hydrogen phosphite, dioleyl hydrogen phosphite, and diethyl hydrogen phosphite, and diphenyl hydrogen phosphite. Among them, from the viewpoint of antiwear property, at least one selected from the group consisting of dioctyl hydrogen phosphite, di(2-ethylhexyl) hydrogen phosphite, dilauryl hydrogen phosphite, and dioleyl hydrogen phosphite is preferable.

The mixing proportion of the phosphonic acid diester and the amine compound may be appropriately set in consideration of the balance between the acid value of the phosphonic acid diester and the base value of the amine compound, for example. The mixing proportion of the phosphonic acid diester and the amine compound (phosphonic acid diester/amine compound) may be, in terms of molar ratio, 1/5 to 10/1, may be 2/3 to 5/1, and may be 1/1 to 4/1, for example. Further, in a case where the phosphonic acid diester is a mixture containing one in which a part thereof has changed to phosphonic acid or phosphonic acid monoester by hydrolysis or the like, the amine compound is preferably 5% by mass or more, more preferably 10% by mass or more, particularly preferably 20% by mass or more, and preferably 80% by mass or less, more preferably 60% by mass or less, still more preferably 50% by mass or less, with respect to the total sum of this mixture and the amine compound.

In the refrigerating machine oil and the method for producing the same according to the present embodiment, it is possible to use hydrocarbon oil, oxygen-containing oil or the like as the lubricating base oil. Examples of the hydrocarbon oil include mineral oil-based hydrocarbon oils and synthetic hydrocarbon oils. Examples of the oxygen-containing oil include esters, ethers, carbonates, ketones, silicones, and polysiloxanes.

The mineral oil-based hydrocarbon oil can be obtained by purifying a lubricating oil fraction obtained by subjecting crude oil such as paraffinic or naphthenic crude oil to atmospheric distillation and vacuum distillation by a method such as solvent deasphalting, solvent purification, hydrogenation purification, hydrogenolysis, solvent dewaxing, hydrogenation dewaxing, clay treatment, sulfuric acid washing, or the like. These purification methods may be used alone or in combination of two or more.

Examples of the synthetic hydrocarbon oil include alkylbenzene, alkylnaphthalene, poly-α-olefin (PAO), polybutene, and ethylene-α-olefin copolymers.

As the alkylbenzene, it is possible to use the following alkylbenzene (A) and/or alkylbenzene (B).

Alkylbenzene (A): alkylbenzene which has 1 to 4 alkyl groups having 1 to 19 carbon atoms and in which the total number of carbon atoms of the alkyl groups is 9 to 19 (preferably, alkylbenzene which has 1 to 4 alkyl groups having 1 to 15 carbon atoms and in which the total number of carbon atoms of the alkyl groups is 9 to 15).

Alkylbenzene (B): alkylbenzene which has 1 to 4 alkyl groups having 1 to 40 carbon atoms and in which the total number of carbon atoms of the alkyl groups is 20 to 40 (preferably, alkylbenzene which has 1 to 4 alkyl groups having 1 to 30 carbon atoms and in which the total number of carbon atoms of the alkyl groups is 20 to 30).

Specific examples of the alkyl group having 1 to 19 carbon atoms of the alkylbenzene (A) include a methyl group, an ethyl group, a propyl group (including all isomers, the same applies hereinafter), a butyl group, a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, a nonadecyl group, and an exocil group. These alkyl groups may be linear or branched, and are preferably branched in terms of stability, viscosity characteristics and the like. In particular, in terms of availability, branched alkyl groups derived from oligomers of olefins such as propylene, butene and isobutylene are more preferable.

The number of alkyl groups in the alkylbenzene (A) is 1 to 4, preferably 1 or 2 (that is, monoalkylbenzene, dialkylbenzene, or a mixture thereof) in terms of stability and availability.

The alkylbenzene (A) may contain only alkylbenzene with a single structure, or may contain a mixture of alkylbenzenes with different structures as long as the alkylbenzenes satisfies the conditions of having 1 to 4 alkyl groups having 1 to 19 carbon atoms and the total number of carbon atoms of alkyl groups being 9 to 19.

Specific examples of the alkyl group having 1 to 40 carbon atoms of the alkylbenzene (B) include a methyl group, an ethyl group, a propyl group (including all isomers, the same applies hereinafter), a butyl group, a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, a nonadecyl group, an icosyl group, a heneicosyl group, a docosyl group, a tricosyl group, a tetracosyl group, a pentacosyl group, a hexacosyl group, a heptacosyl group, an octacosyl group, a nonacosyl group, a triacontyl group, a hentriacontyl group, a dotriacontyl group, a tritriacontyl group, a tetratriacontyl group, a pentatriacontyl group, a hexatriacontyl group, a heptatriacontyl group, an octatriacontyl group, a nonatriacontyl group, and a tetracontyl group. These alkyl groups may be linear or branched, and are preferably branched in terms of stability, viscosity characteristics and the like. In particular, in terms of availability, branched alkyl groups derived from oligomers of olefins such as propylene, butene and isobutylene are more preferable.

The number of alkyl groups in the alkylbenzene (B) is 1 to 4, preferably 1 or 2 (that is, monoalkylbenzene, dialkylbenzene, or a mixture thereof) in terms of stability and availability.

The alkylbenzene (B) may contain only alkylbenzene with a single structure, or may contain a mixture of alkylbenzenes with different structures as long as the alkylbenzenes satisfies the conditions of having 1 to 4 alkyl groups having 1 to 40 carbon atoms and the total number of carbon atoms of alkyl groups being 20 to 40.

The poly-α-olefin (PAO) is a compound obtained, for example, by polymerizing a molecule of a linear olefin having 6 to 18 carbon atoms having a double bond on only one of the ends, and then hydrogenating the molecule. The poly-α-olefin may be, for example, an isoparaffin having a molecular weight distribution which is centered around a trimer or tetramer of α-decene having 10 carbon atoms or α-dodecene having 12 carbon atoms.

Examples of the ester include aromatic esters, dibasic acid esters, polyol esters, complex esters, carbonic acid esters, and mixtures thereof. As the ester, a polyol ester or a complex ester is preferable.

The polyol ester is an ester of a polyhydric alcohol and a fatty acid. As the fatty acid, saturated fatty acid is preferably used. It is preferable for the number of carbon atoms of the fatty acid to be 4 to 20, more preferable to be 4 to 18, and still more preferable to be 4 to 9. The polyol ester may be a partial ester in which some of the hydroxyl groups of the polyhydric alcohol are not esterified and remain as hydroxyl groups, may be a complete ester in which all the hydroxyl groups are esterified, or may be a mixture of a partial ester and a complete ester. The hydroxyl value of the polyol ester is preferably 10 mgKOH/g or less, more preferably 5 mgKOH/g or less, and still more preferably 3 mgKOH/g or less.

Of the fatty acids constituting the polyol ester, it is preferable for the proportion of fatty acids having 4 to 20 carbon atoms to be 20 to 100 mol %, more preferable to be 50 to 100 mol %, still more preferable to be 70 to 100 mol %, and particularly preferable to be 90 to 100 mol %.

Specific examples of fatty acids having 4 to 20 carbon atoms include a butanoic acid, a pentanoic acid, a hexanoic acid, a heptanoic acid, an octanoic acid, a nonanoic acid, a decanoic acid, a undecanoic acid, a dodecanoic acid, a tridecanoic acid, a tetradecanoic acid, a pentadecanoic acid, a hexadecanoic acid, a heptadecanoic acid, an octadecanoic acid, a nonadecanoic acid, and an icosanoic acid. These fatty acids may be linear or branched. More specifically, a fatty acid having a branch at the α-position and/or β-position is preferable, and 2-methylpropanoic acid, 2-methylbutanoic acid, 2-methylpentanoic acid, 2-methylhexanoic acid, 2-ethylpentanoic acid, 2-methylheptanoic acid, 2-ethylhexanoic acid, 3,5,5-trimethylhexanoic acid, 2-ethylhexadecanoic acid and the like are more preferable, and among them, 2-ethylhexanoic acid, 3,5,5-trimethylhexanoic acid are still more preferable.

The fatty acid may contain a fatty acid other than the fatty acid having 4 to 20 carbon atoms. The fatty acid other than the fatty acid having 4 to 20 carbon atoms may be, for example, a fatty acid having 21 to 24 carbon atoms. Specific examples thereof include henicoic acid, docosanoic acid, tricosanoic acid, and tetracosanoic acid. These fatty acids may be linear or branched.

As the polyhydric alcohol constituting the polyol ester, a polyhydric alcohol having 2 to 6 hydroxyl groups is preferably used. The number of carbon atoms of the polyhydric alcohol is preferably 4 to 12, and more preferably 5 to 10. Specifically, hindered alcohol such as neopentyl glycol, trimethylolethane, trimethylolpropane, trimethylolbutane, di-(trimethylolpropane), tri-(trimethylolpropane), pentaerythritol, and dipentaerythritol are preferable. Pentaerythritol or a mixed ester of pentaerythritol and dipentaerythritol is more preferable because it is particularly excellent in compatibility with a refrigerant and hydrolysis stability.

The complex ester is, for example, an ester synthesized by the following method (a) or (b).

(a) a method of synthesizing an ester intermediate in which a part of carboxyl groups of a polybasic acid is not esterified by adjusting a molar ratio between the polyhydric alcohol and the polybasic acid, and then esterifying the remaining carboxyl group with a monohydric alcohol.

(b) a method of synthesizing an ester intermediate in which a part of hydroxyl groups of a polyhydric alcohol is not esterified by adjusting a molar ratio between the polyhydric alcohol and the polybasic acid, and then esterifying the remaining hydroxyl group with a monovalent fatty acid.

A relatively strong acid is not (less likely to be) produced when hydrolyzed when used as a refrigerating machine oil, so that the complex ester obtained by the above method (a) tends to be more excellent in stability compared to the complex ester obtained by the above method (b). As the complex ester in the present embodiment, the complex ester obtained by the above method (a), which has higher stability, is preferable.

The complex ester is preferably an ester synthesized from at least one selected from polyhydric alcohols having 2 to 4 hydroxyl groups, at least one selected from polybasic acids having 6 to 12 carbon atoms, and at least one selected from monohydric alcohols having 4 to 18 carbon atoms and monovalent fatty acids having 2 to 12 carbon atoms.

Examples of the polyhydric alcohol having 2 to 4 hydroxyl groups include neopentyl glycol, trimethylolpropane, and pentaerythritol. As the polyhydric alcohol having 2 to 4 hydroxyl groups, neopentyl glycol and trimethylolpropane are preferable from the viewpoint that good low-temperature characteristics are obtained by ensuring a suitable viscosity when the complex ester is used as a base oil, and neopentyl glycol is more preferable from the viewpoint that the viscosity can be widely adjusted.

From the viewpoint of excellent lubricity, it is preferable for the polyhydric alcohol constituting the complex ester to further contain a dihydric alcohol having 2 to 10 carbon atoms other than neopentyl glycol in addition to the polyhydric alcohol having 2 to 4 hydroxyl groups. Examples of the dihydric alcohol having 2 to 10 carbon atoms other than neopentyl glycol include ethylene glycol, propanediol, butanediol, pentanediol, hexanediol, 2-methyl-1,3-propanediol, 3-methyl-1,5-pentanediol, and 2,2-diethyl-1,3-pentanediol. Among these, butanediol is preferable from the viewpoint of excellent characteristics of the lubricating base oil. Examples of butanediol include 1,2-butanediol, 1,3-butanediol, 1,4-butanediol, and 2,3-butanediol. Among these, 1,3-butanediol and 1,4-butanediol are more preferable from the viewpoint that good characteristics are obtained. It is preferable for the amount of the dihydric alcohol having 2 to 10 carbon atoms other than neopentyl glycol to be 1.2 mol or less, more preferable to be 0.8 mol or less, and still more preferable to be 0.4 mol or less, with respect to 1 mol of the polyhydric alcohol having 2 to 4 hydroxyl groups.

Examples of the polybasic acid having 6 to 12 carbon atoms include adipic acid, pimelic acid, suberic acid, azelaic acid, sebacic acid, phthalic acid, and trimellitic acid. Among these, adipic acid and sebacic acid are preferable, and adipic acid is more preferable, from the viewpoint of excellent balance of characteristics of the synthesized ester and easy availability. It is preferable for the amount of the polybasic acid having 6 to 12 carbon atoms to be 0.4 mol to 4 mol, more preferable to be 0.5 mol to 3 mol, and still more preferable to be 0.6 mol to 2.5 mol, with respect to 1 mol of the polyhydric alcohol having 2 to 4 hydroxyl groups.

Examples of the monohydric alcohol having 4 to 18 carbon atoms include aliphatic alcohols such as butanol, pentanol, hexanol, heptanol, octanol, nonanol, decanol, dodecanol, and oleyl alcohol. These monohydric alcohols may be linear or branched. The monohydric alcohol having 4 to 18 carbon atoms is preferably a monohydric alcohol having 6 to 10 carbon atoms, and more preferably a monohydric alcohol having 8 to 10 carbon atoms, in terms of the balance of characteristics. Among these, 2-ethylhexanol and 3,5,5-trimethylhexanol are still more preferable from the viewpoint that the low-temperature characteristics of the synthesized complex ester becomes good.

Examples of monovalent fatty acids having 2 to 12 carbon atoms include ethane acid, propanoic acid, butanoic acid, pentanoic acid, hexanoic acid, heptanoic acid, octanoic acid, nonanoic acid, decanoic acid, and dodecanoic acid. These monovalent fatty acids may be linear or branched. The monovalent fatty acid having 2 to 12 carbon atoms is preferably a monovalent fatty acid having 8 to 10 carbon atoms, and more preferably 2-ethylhexanoic acid and 3,5,5-trimethylhexanoic acid among these from the viewpoint of low-temperature characteristics.

Examples of the ether include polyvinyl ether, polyalkylene glycol, polyphenyl ether, perfluoro ether, and a mixture thereof. As the ether, polyvinyl ether or polyalkylene glycol is preferable, and polyvinyl ether is more preferable.

Polyvinyl ether has a structural unit represented by the following formula (4).

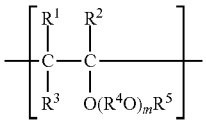

(4)

In formula (4), $R^1$, $R^2$ and $R^3$ may be the same as or different from each other and each represent a hydrogen atom or a hydrocarbon group, $R^4$ represents a divalent hydrocarbon group or a divalent ether-bonded oxygen-containing hydrocarbon group, $R^5$ represents a hydrocarbon group, and m represents an integer of 0 or more. In a case where m is 2 or more, the plurality of $R^4$ may be the same as or different from each other.

The number of carbon atoms of the hydrocarbon groups represented by $R^1$, $R^2$ and $R^3$ is preferably 1 or more, more preferably 2 or more, still more preferably 3 or more, and preferably 8 or less, more preferably 7 or less, still more preferably 6 or less. It is preferable for at least one of $R^1$, $R^2$ and $R^3$ to be a hydrogen atom, and it is more preferable for all of $R^1$, $R^2$ and $R^3$ to be a hydrogen atom.

The number of carbon atoms of the divalent hydrocarbon group and the ether-bonded oxygen-containing hydrocarbon group represented by $R^4$ is preferably 1 or more, more preferably 2 or more, still more preferably 3 or more, and preferably 10 or less, more preferably 8 or less, still more preferably 6 or less. The divalent ether-bonded oxygen-containing hydrocarbon group represented by $R^4$ may be, for example, a hydrocarbon group having oxygen forming an ether bond in the side chain.

It is preferable for $R^5$ to be a hydrocarbon group having 1 to 20 carbon atoms. Examples of this hydrocarbon group include an alkyl group, a cycloalkyl group, a phenyl group, an aryl group, and an arylalkyl group. Among these, an alkyl group is preferable, and an alkyl group having 1 to 5 carbon atoms is more preferable.

m is preferably 0 or more, more preferably 1 or more, still more preferably 2 or more, and preferably 20 or less, more preferably 18 or less, still more preferably 16 or less. It is preferable for the average value of m in all the structural units constituting the polyvinyl ether to be 0 to 10.

The polyvinyl ether may be a homopolymer constituted by one selected from the structural units represented by formula (4), may be a copolymer constituted by two or more selected from the structural units represented by formula (4), or may be a copolymer constituted by a structural unit represented by formula (4) and another structural unit. Since the polyvinyl ether is a copolymer, it is possible to further improve the lubricity, insulating property, hygroscopic property and the like while satisfying compatibility of the refrigerating machine oil with the refrigerant. At this time, by appropriately selecting the type of the monomer as the raw material, the type of the initiator, the ratio of the structural units in the copolymer, and the like, it is possible to set various characteristics of the refrigerating machine oil above to desired ones. The copolymer may be either a block copolymer or a random copolymer.

In a case where the polyvinyl ether is a copolymer, it is preferable for the copolymer to have a structural unit (4-1) which is represented by the above formula (4) and in which $R^5$ is an alkyl group having 1 to 3 carbon atoms and a structural unit (4-2) which is represented by the above formula (4) and in which $R^5$ is an alkyl group having 3 to 20 carbon atoms, preferably 3 to 10 carbon atoms, and still more preferably 3 to 8 carbon atoms. An ethyl group is particularly preferable as $R^5$ in the structural unit (4-1), and an isobutyl group is particularly preferable as $R^5$ in the structural unit (4-2). In a case where the polyvinyl ether is a copolymer having the above structural units (4-1) and (4-2), it is preferable for the molar ratio between the structural unit (4-1) and the structural unit (4-2) to be 5:95 to 95:5, more preferable to be 20:80 to 90:10, and still more preferable 70:30 to 90:10. When the molar ratio is within the above range, it is possible to further improve the compatibility with the refrigerant, and there is a tendency in that the hygroscopic property can be reduced.

The polyvinyl ether may only be constituted by the structural unit represented by the above formula (4), or may be a copolymer further having the structural unit represented by the following formula (5). In this case, the copolymer may be either a block copolymer or a random copolymer.

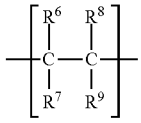

(5)

In formula (5), $R^6$ to $R^9$ may be the same as or different from each other, and each represent a hydrogen atom or a hydrocarbon group having 1 to 20 carbon atoms.

The polyvinyl ether can be produced by polymerizing a vinyl ether-based monomer corresponding to the structural unit represented by formula (4) or by copolymerizing a vinyl ether-based monomer corresponding to the structural unit represented by formula (4) with a hydrocarbon monomer having an olefinic double bond corresponding to the structural unit represented by formula (5). As the vinyl ether-based monomer corresponding to the structural unit represented by formula (4), a monomer represented by the following formula (6) is suitable.

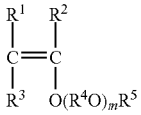

(6)

In the formula (6), $R^1$, $R^2$, $R^3$, $R^4$, $R^5$ and m represent the same definitions as $R^1$, $R^2$, $R^3$, $R^4$, $R^5$ and m in formula (4), respectively.

It is preferable for the polyvinyl ether to have the following terminal structure (A) or (B).

(A) structure in which one end is represented by formula (7) or (8) and the other end is represented by formula (9) or (10).

(7)

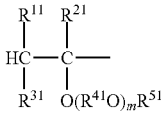

In formula (7), $R^{11}$, $R^{21}$ and $R^{31}$ may be the same as or different from each other, and each represents a hydrogen atom or a hydrocarbon group having 1 to 8 carbon atoms, $R^{41}$ represents a divalent hydrocarbon group or a divalent ether-bonded oxygen-containing hydrocarbon group having 1 to 10 carbon atoms, $R^{51}$ represents a hydrocarbon group having 1 to 20 carbon atoms, and m represents the same definition as m in formula (4). In a case where m is 2 or more, the plurality of $R^{41}$ may be the same as or different from each other.

(8)

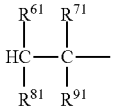

In formula (8), $R^{61}$, $R^{71}$, $R^{81}$ and $R^{91}$ may be the same as or different from each other, and each represent a hydrogen atom or a hydrocarbon group having 1 to 20 carbon atoms.

(9)

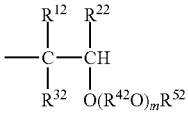

In formula (9), $R^{12}$, $R^{22}$ and $R^{32}$ may be the same as or different from each other, and each represents a hydrogen atom or a hydrocarbon group having 1 to 8 carbon atoms, $R^{42}$ represents a divalent hydrocarbon group or a divalent ether-bonded oxygen-containing hydrocarbon group having 1 to 10 carbon atoms, $R^{52}$ represents a hydrocarbon group having 1 to 20 carbon atoms, and m represents the same definition as m in formula (4). In a case where m is 2 or more, the plurality of $R^{41}$ may be the same or different.

(10)

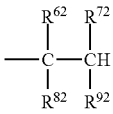

In formula (10), $R^{62}$, $R^{72}$, $R^{82}$ and $R^{92}$ may be the same as or different from each other, and each represent a hydrogen atom or a hydrocarbon group having 1 to 20 carbon atoms.

(B) structure in which one end is represented by the above formula (7) or (8) and the other end is represented by the following formula (11).

(11)

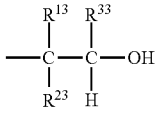

In formula (11), $R^{13}$, $R^{23}$, and $R^{33}$ may be the same as or different from each other, and each represent a hydrogen atom or a hydrocarbon group having 1 to 8 carbon atoms.

Among such polyvinyl ethers, the polyvinyl ethers (a), (b), (c), (d) and (e) listed below are particularly suitable as the base oil.

(a) polyvinyl ether having a structure in which one end is represented by formula (7) or (8) and the other end is represented by formula (9) or (10), in which $R^1$, $R^2$ and $R^3$ in formula (4) are all hydrogen atoms, m is an integer of 0 to 4, $R^4$ is a divalent hydrocarbon group having 2 to 4 carbon atoms, and $R^5$ is a hydrocarbon group having 1 to 20 carbon atoms.

(b) polyvinyl ether having only the structural unit represented by formula (4) and having a structure in which one end is represented by formula (7) and the other end is represented by formula (9), in which $R^1$, $R^2$ and $R^3$ in formula (4) are all hydrogen atoms, m is an integer of 0 to 4, $R^4$ is a divalent hydrocarbon group having 2 to 4 carbon atoms, and $R^5$ is a hydrocarbon group having 1 to 20 carbon atoms.

(c) polyvinyl ether having a structure in which one end is represented by formula (7) or (8) and the other end is represented by formula (11), in which $R^1$, $R^2$ and $R^3$ in formula (4) are all hydrogen atoms, m is an integer of 0 to 4, $R^4$ is a divalent hydrocarbon group having 2 to 4 carbon atoms, and $R^5$ is a hydrocarbon group having 1 to 20 carbon atoms.

(d) polyvinyl ether having only the structural unit represented by formula (4) and having a structure in which one end is represented by formula (8) and the other end is represented by formula (11), in which $R^1$, $R^2$ and $R^3$ in formula (4) are all hydrogen atoms, m is an integer of 0 to 4, $R^4$ is a divalent hydrocarbon group having 2 to 4 carbon atoms, and $R^5$ is a hydrocarbon group having 1 to 20 carbon atoms.

(e) polyvinyl ether being any of above (a), (b), (c) and (d) and having a structural unit in which $R^5$ in formula (4) is a hydrocarbon group having 1 to 3 carbon atoms and a structural unit in which the $R^5$ is a hydrocarbon group having 3 to 20 carbon atoms.

It is preferable for the unsaturation degree of polyvinyl ether to be 0.04 meq/g or less, more preferable to be 0.03 meq/g or less, and still more preferable to be 0.02 meq/g or less. It is preferable for the peroxide value of polyvinyl ether to be 10.0 meq/kg or less, more preferable to be 5.0 meq/kg or less, and still more preferable to be 1.0 meq/kg. It is preferable for the carbonyl value of polyvinyl ether to be 100 ppm by weight or less, more preferable to be 50 ppm by weight or less, and still more preferable to be 20 ppm by weight or less. It is preferable for the hydroxyl value of polyvinyl ether to be 10 mgKOH/g or less, more preferable to be 5 mgKOH/g or less, and still more preferable to be 3 mgKOH/g or less.

The unsaturation degree, the peroxide value, and the carbonyl value in the present invention refer to the values measured by the standard oil and fat analysis test method established by the Japan Oil Chemists' Society, respectively. That is, the unsaturation degree in the present invention refers to a value (meq/g) obtained by reacting a sample with a Wijs solution (ICl-acetic acid solution), allowing the sample to stand in a dark place, reducing excess ICl to iodine thereafter, titrating the iodine content with sodium thiosulfate to calculate an iodine value, and converting the iodine value into a vinyl equivalent. The peroxide value in the present invention refers to a value (meq/kg) obtained by adding potassium iodide to a sample, titrating the generated free iodine with sodium thiosulfate, and converting this free iodine into milliequivalents with respect to 1 kg of the sample. The carbonyl value in the present invention refers to a value (ppm by weight) obtained by allowing 2,4-dinitrophenylhydrazine to act on a sample to generate a chromogenic quinoid ion, measuring the absorbance of this sample at 480 nm, and converting into the carbonyl amount based on a calibration curve obtained in advance using cinnamaldehyde as a standard substance. The hydroxyl value in the present invention means a hydroxyl value measured in accordance with JIS K0070:1992.

Examples of the polyalkylene glycol include polyethylene glycol, polypropylene glycol, and polybutylene glycol. The polyalkylene glycol has oxyethylene, oxypropylene, oxybutylene and the like as structural units. The polyalkylene glycols having these structural units can be obtained by ring-opening polymerization using ethylene oxide, propylene oxide, and butylene oxide as monomers, respectively, as raw materials.

Examples of the polyalkylene glycol include compounds represented by the following formula (12).

$$R^{\alpha}—[(OR^{\beta})_f OR^{\gamma}]_g \quad (12)$$

In formula (12), $R^{\alpha}$ represents a hydrogen atom, an alkyl group having 1 to 10 carbon atoms, an acyl group having 2 to 10 carbon atoms, or a residue of a compound having 2 to 8 hydroxyl groups, $R^{\beta}$ represents an alkylene group having 2 to 4 carbon atoms, $R^{\gamma}$ represents a hydrogen atom, an alkyl group having 1 to 10 carbon atoms, or an acyl group having 2 to 10 carbon atoms, f represents an integer of 1 to 80, and g represents an integer of 1 to 8.

The alkyl group represented by $R^{\alpha}$ or $R^{\gamma}$ may be linear, branched or cyclic. The number of carbon atoms of the alkyl group is preferably 1 to 10, and more preferably 1 to 6. When the number of carbon atoms of the alkyl group is 10 or less, there is a tendency in that the compatibility with the refrigerant is well maintained.

The alkyl group portion of the acyl group represented by $R^{\alpha}$ or $R^{\gamma}$ may be linear, branched or cyclic. The number of carbon atoms of the acyl group is preferably 2 to 10, and more preferably 2 to 6. When the number of carbon atoms of the acyl group is 10 or less, the compatibility with the refrigerant is maintained and the possibility that phase separation occurs is low.

In a case where the groups represented by $R^{\alpha}$ and $R^{\gamma}$ are both alkyl groups, or in a case of both being acyl groups, the groups represented by $R^{\alpha}$ and $R^{\gamma}$ may be the same or different. In a case where g is 2 or more, the groups represented by a plurality of $R^{\alpha}$ and $R^{\gamma}$ in the same molecule may be the same or different.

In a case where the group represented by $R^{\alpha}$ is a residue of a compound having 2 to 8 hydroxyl groups, this compound may be linear or cyclic.

At least one of $R^{\alpha}$ and $R^{\gamma}$ is preferably an alkyl group, more preferably an alkyl group having 1 to 4 carbon atoms, and still more preferably a methyl group from the viewpoint of excellent compatibility. From the viewpoint of excellent thermal/chemical stability, both $R^{\alpha}$ and $R^{\gamma}$ are preferably an alkyl group, more preferably an alkyl group having 1 to 4 carbon atoms, and still more preferably a methyl group. From the viewpoint of ease of production and cost, it is preferable that either one of $R^{\alpha}$ and $R^{\gamma}$ be an alkyl group (more preferably, an alkyl group having 1 to 4 carbon atoms) and the other be a hydrogen atom, and more preferable that one be a methyl group and the other be a hydrogen atom. From the viewpoint of excellent lubricity and sludge solubility, it is preferable that both $R^{\alpha}$ and $R^{\gamma}$ be hydrogen atoms.

$R^{\beta}$ represents an alkylene group having 2 to 4 carbon atoms, and specific examples of such an alkylene group include an ethylene group, a propylene group, and a butylene group. Examples of the oxyalkylene group of the repeating unit represented by $OR^{\beta}$ include an oxyethylene group, an oxypropylene group, and an oxybutylene group. The oxyalkylene group represented by $(OR^{\beta})_f$ may be constituted by one kind of oxyalkylene group or two or more kinds of oxyalkylene group.

Among the polyalkylene glycols represented by formula (12), from the viewpoint of excellent compatibility with the refrigerant and viscosity-temperature characteristics, a copolymer containing an oxyethylene group (EO) and an oxypropylene group (PO) is preferable. In this case, it is preferable for the proportion of the oxyethylene group (EO/(PO+EO)) to the total sum of the oxyethylene group and the oxypropylene group to be 0.1 to 0.8, and more preferable to be 0.3 to 0.6, from the viewpoint of excellent seizure load and viscosity-temperature characteristics. From the viewpoint of excellent hygroscopic property and thermal/oxidative stability, it is preferable for EO/(PO+EO) to be 0 to 0.5, more preferable to be 0 to 0.2, and most preferable to be 0 (that is, propylene oxide homopolymer).

f represents the number of repetitions (polymerization degree) of the oxyalkylene group $OR^{\beta}$, and is an integer of 1 to 80. g is an integer from 1 to 8. For example, in a case where $R^{\alpha}$ is an alkyl group or an acyl group, g is 1. In a case where $R^{\alpha}$ is a residue of a compound having 2 to 8 hydroxyl groups, g is the number of hydroxyl groups that the compound has.

In polyalkylene glycol represented by formula (12), it is preferable for the average value of the product (f×g) of f and g to be 6 to 80 from the viewpoint of satisfying the required performance as a refrigerating machine oil in a well-balanced manner.

The number-average molecular weight of the polyalkylene glycol represented by formula (12) is preferably 500 or more, more preferably 600 or more, and preferably 3000 or less, more preferably 2000 or less, still more preferably 1500 or less. It is preferable for f and g to be numbers such that the number-average molecular weight of the polyalkylene glycol satisfies the above conditions. When the number-average molecular weight of the polyalkylene glycol is 500 or more, lubricity under coexistence of the refrigerant becomes sufficient. When the number-average molecular weight is 3000 or less, the composition range showing compatibility with the refrigerant is wide even under low-temperature conditions, and poor lubrication of the refrigerant compressor and inhibition of heat exchange in the evaporator are less likely to occur.

The hydroxyl value of the polyalkylene glycol is preferably 100 mgKOH/g or less, more preferably 50 mgKOH/g or less, still more preferably 30 mgKOH/g or less, and most preferably 10 mgKOH/g or less.

Polyalkylene glycols can be synthesized using known methods ("alkylene oxide polymer", Mita Shibata et al., Kaibundo, published on Nov. 20, 1990). For example, the polyalkylene glycol represented by the formula (12) can be obtained by subjecting an alcohol ($R^{\alpha}OH$; $R^{\alpha}$ represents the same definition as $R^{\alpha}$ in formula (12)) to addition polymerization with one or more kinds of predetermined alkylene oxides and then etherifying or esterifying a terminal hydroxyl group. In a case where two or more kinds of alkylene oxides are used in the above production process, the obtained polyalkylene glycol may be either a random copolymer or a block copolymer, but it is preferable for the polyalkylene glycol to be a block copolymer because it tends to be superior in oxidation stability and lubricity, and it is preferable for the polyalkylene glycol to be a random copolymer because it tends to be superior in low-temperature fluidity.

It is preferable for the unsaturation degree of polyalkylene glycol to be 0.04 meq/g or less, more preferable to be 0.03 meq/g or less, and most preferable to be 0.02 meq/g or less. It is preferable for the peroxide value to be 10.0 meq/kg or less, more preferable to be 5.0 meq/kg or less, and most preferable to be 1.0 meq/kg. It is preferable for the carbonyl value to be 100 ppm by weight or less, more preferable to be 50 ppm by weight or less, and most preferable to be 20 ppm by weight or less.

The kinematic viscosity of the lubricating base oil at 40° C. may be preferably 3 $mm^2/s$ or more, more preferably 4 $mm^2/s$ or more, and still more preferably 5 $mm^2/s$ or more. The kinematic viscosity of the lubricating base oil at 40° C. may be preferably 1000 $mm^2/s$ or less, more preferably 500 $mm^2/s$ or less, and still more preferably 400 $mm^2/s$ or less. The kinematic viscosity of the lubricating base oil at 100° C. may be preferably 1 $mm^2/s$ or more, and more preferably 2 $mm^2/s$ or more. The kinematic viscosity of the lubricating base oil at 100° C. may be preferably 100 $mm^2/s$ or less, and more preferably 50 $mm^2/s$ or less. The kinematic viscosity in the present invention means a kinematic viscosity measured in accordance with JIS K2283:2000.

The content of the lubricating base oil may be 50% by mass or more, 60% by mass or more, 70% by mass or more, 80% by mass or more, or 90% by mass or more, based on the total amount of refrigeration machine oil.

The refrigerating machine oil may further contain other additives in addition to the above-mentioned amine salt in the present embodiment. Examples of the other additives include an acid scavenger, an antioxidant, an extreme pressure agent, an oiliness agent, an antifoaming agent, a metal deactivator, a viscosity index improver, a pour point depressant, a detergent dispersant, and an antiwear agent other than phosphonic acid and phosphonic acid monoester. The contents of these additives may each be preferably 10% by mass or less, and more preferably 5% by mass or less, based on the total amount of refrigerating machine oil. In the method for producing a refrigerating machine oil in the present embodiment, these additives may be added before blending the above-mentioned amine salt in the present embodiment or the phosphonic acid diester and the amine compound in the present embodiment to the lubricating base oil, may be added after blending, or may be blended at the same time.

Examples of the acid scavenger include an epoxy compound (epoxy-based acid scavenger). Examples of the epoxy compound include a glycidyl ether type epoxy compound, a glycidyl ester type epoxy compound, an oxylan compound, an alkyloxylan compound, an alicyclic epoxy compound, an epoxidized fatty acid monoester, and an epoxidized vegetable oil. These epoxy compounds can be used alone or in combination of two or more.

As the glycidyl ether type epoxy compound, it is possible to use, for example, an aryl glycidyl ether type epoxy compound or an alkyl glycidyl ether type epoxy compound represented by the following formula (13).

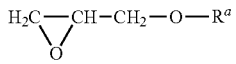

(13)

In formula (13), $R^a$ represents an aryl group or an alkyl group having 5 to 18 carbon atoms.

As the glycidyl ether type epoxy compound represented by formula (13), n-butylphenyl glycidyl ether, i-butylphenyl glycidyl ether, sec-butylphenyl glycidyl ether, tert-butylphenyl glycidyl ether, pentylphenyl glycidyl ether, and hexylphenyl glycidyl ether, heptylphenyl glycidyl ether, octylphenyl glycidyl ether, nonylphenyl glycidyl ether, decylphenyl glycidyl ether, decyl glycidyl ether, undecyl glycidyl ether, dodecyl glycidyl ether, tridecyl glycidyl ether, tetradecyl glycidyl ether, and 2-ethylhexyl glycidyl ether are preferable.

When the number of carbon atoms of the alkyl group represented by $R^a$ is 5 or more, the stability of the epoxy compound is secured, and it is possible to suppress the decomposition of the epoxy compound before reacting with moisture, a fatty acid, or an oxidatively deteriorated substance or the occurrence of self-polymerization in which the epoxy compounds are polymerized, and the desired function can be easily obtained. Meanwhile, when the number of carbon atoms of the alkyl group represented by $R^a$ is 18 or less, the solubility with the refrigerant is well maintained, and it is possible to prevent problems such as poor cooling from occurring due to precipitation in the refrigerating apparatus.

As the glycidyl ether type epoxy compound, in addition to the epoxy compound represented by the formula (13), it is also possible to use neopentyl glycol diglycidyl ether, trimethylolpropane triglycidyl ether, pentaerythritol tetraglycidyl ether, 1,6-hexanediol diglycidyl ether, sorbitol polyglycidyl ether, polyalkylene glycol monoglycidyl ether, polyalkylene glycol diglycidyl ether or the like.

As the glycidyl ester type epoxy compound, it is possible to use, for example, a compound represented by the following formula (14).

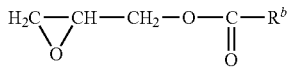

(14)

In formula (14), $R^b$ represents an aryl group, an alkyl group having 5 to 18 carbon atoms, or an alkenyl group.

As the glycidyl ester type epoxy compound represented by formula (14), glycidyl benzoate, glycidyl neodecanoate, glycidyl-2,2-dimethyloctanoate, glycidyl acrylate, and glycidyl methacrylate are preferable.

When the number of carbon atoms of the alkyl group represented by $R^b$ is 5 or more, the stability of the epoxy compound is secured, and it is possible to suppress the decomposition of the epoxy compound before reacting with moisture, a fatty acid, or an oxidatively deteriorated substance or the occurrence of self-polymerization in which the epoxy compounds are polymerized, and the desired function can be easily obtained. Meanwhile, when the number of carbon atoms of the alkyl group or the alkenyl group represented by $R^b$ is 18 or less, the solubility with the refrigerant is well maintained, and it is possible to prevent problems such as poor cooling from occurring due to precipitation in the refrigerating machine.

The alicyclic epoxy compound is a compound represented by the following formula (15) and having a partial structure in which carbon atoms constituting the epoxy group directly constitute an alicyclic ring.

(15)

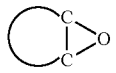

As the alicyclic epoxy compound, 1,2-epoxycyclohexane, 1,2-epoxycyclopentane, 3',4'-epoxycyclohexylmethyl-3,4-epoxycyclohexanecarboxylate, bis(3,4-epoxycyclohexylmethyl)adipate, exo-2,3-epoxynorbornane, bis(3,4-epoxy-6-methylcyclohexylmethyl)adipate, 2-(7-oxabicyclo[4.1.0]hept-3-yl)-spiro(1,3-dioxane-5,3'-[7]oxabicyclo[4.1.0]heptane, 4-(1'-methylepoxyethyl)-1,2-epoxy-2-methylcyclohexane, and 4-epoxyethyl-1,2-epoxycyclohexane are preferable.

Examples of the allyloxylane compound include 1,2-epoxystyrene and alkyl-1,2-epoxystyrene.

Examples of the alkyloxylan compound include 1,2-epoxybutane, 1,2-epoxypentane, 1,2-epoxyhexane, 1,2-epoxyheptan, 1,2-epoxyoctane, 1,2-epoxynonane, 1,2-epoxy decane, 1,2-epoxy undecane, 1,2-epoxy dodecane, 1,2-epoxy tridecane, 1,2-epoxy tetradecane, 1,2-epoxy pentadecane, 1,2-epoxy hexadecane, 1,2-epoxy heptadecane, 1,1,2-epoxy octadecane, 2-epoxy nonadecan, and 1,2-epoxy icosan.

Examples of the epoxidized fatty acid monoester include an ester of an epoxidized fatty acid having 12 to 20 carbon atoms and an alcohol having 1 to 8 carbon atoms or a phenol or an alkylphenol. As the epoxidized fatty acid monoester, butyl, hexyl, benzyl, cyclohexyl, methoxyethyl, octyl, phenyl and butylphenyl ester of epoxy stearic acid are preferably used.

Examples of the epoxidized vegetable oil include epoxy compounds of vegetable oils such as soybean oil, linseed oil, and cottonseed oil.

The epoxy compound is preferably at least one selected from glycidyl ester type epoxy compounds and glycidyl ether type epoxy compounds, and is preferably at least one selected from glycidyl ester type epoxy compounds from the viewpoint of excellent compatibility with a resin material (for example, nylon) used for a member in a refrigerating machine.

Examples of the antioxidant include phenol-based antioxidants such as di-tert.butyl-p-cresol.

Examples of the antiwear agent include phosphorus-based antiwear agents. Such phosphorus-based antiwear agent may be alkylhydrogen phosphite; phosphoric acid ester such as triphenyl phosphate (TPP) and tricresyl phosphate (TCP); and thiophosphoric acid ester such as triphenylphosphorothionate (TPPT).

The kinematic viscosity of the refrigerating machine oil at 40° C. may be preferably 3 $mm^2/s$ or more, more preferably 4 $mm^2/s$ or more, and still more preferably 5 $mm^2/s$ or more. The kinematic viscosity of the refrigerating machine oil at 40° C. may be preferably 500 $mm^2/s$ or less, more preferably 400 $mm^2/s$ or less, and still more preferably 300 $mm^2/s$ or less. The kinematic viscosity of the refrigerating machine oil at 100° C. may be preferably 1 $mm^2/s$ or more, and more preferably 2 $mm^2/s$ or more. The kinematic viscosity of the refrigerating machine oil at 100° C. may be preferably 100 $mm^2/s$ or less, and more preferably 50 $mm^2/s$ or less.

The pour point of the refrigerating machine oil may be preferably −10° C. or lower, and more preferably −20° C. or lower. The pour point in the present invention means a pour point measured in accordance with JIS K2269:1987.

The volume resistivity of the refrigerating machine oil may be preferably $1.0\times10^9$ Ω·m or more, more preferably $1.0\times10^{10}$ Ω·m or more, and still more preferably $1.0\times10^{11}$ Ω·m or more. The volume resistivity in the present invention means a volume resistivity at 25° C. measured in accordance with JIS C2101:1999.

The moisture content of the refrigerating machine oil may be preferably 200 ppm or less, more preferably 100 ppm or less, and still more preferably 50 ppm or less, based on the total amount of refrigerating machine oil. The moisture content in the present invention means a moisture content measured in accordance with JIS K2275.

The acid value of the refrigerating machine oil may be preferably 1.0 mgKOH/g or less, and more preferably 0.1 mgKOH/g or less. The acid value in the present invention means an acid value measured in accordance with JIS K2501:2003.

The ash content of the refrigerating machine oil may be preferably 100 ppm or less, and more preferably 50 ppm or less. The ash content in the present invention means an ash content measured in accordance with JIS K2272:1998.

The refrigerating machine oil according to the present embodiment is usually present as a working fluid composition for a refrigerating machine which is mixed with a refrigerant in a refrigerating machine. That is, the refrigerating machine oil according to the present embodiment is used together with the refrigerant, and the working fluid composition for the refrigerating machine according to the present embodiment contains the refrigerating machine oil and a refrigerant according to the present embodiment.

Examples of such a refrigerant include fluorine-containing ether-based refrigerants such as saturated fluorinated hydrocarbon refrigerants, unsaturated fluorinated hydrocarbon refrigerants, hydrocarbon refrigerants, and perfluoroethers, bis(trifluoromethyl)sulfide refrigerants, trifluoroiodomethane refrigerants, natural refrigerants such as ammonia and carbon dioxide, mixed refrigerants of two or more kinds selected from these refrigerants.

Examples of the saturated fluorinated hydrocarbon refrigerant include saturated fluorinated hydrocarbons having, preferably, 1 to 3 carbon atoms, more preferably 1 to 2 carbon atoms. Specific examples thereof include difluoromethane (R32), trifluoromethane (R23), pentafluoroethane (R125), 1,1,2,2-tetrafluoroethane (R134), 1,1,1,2-tetrafluoroethane (R134a), 1,1,1-trifluoroethane (R143a), 1,1-difluoroethane (R152a), fluoroethane (R161), 1,1,1,2,3,3,3-heptafluoropropane (R227ea), 1,1,1,2,3,3-hexafluoropropane (R236ea), 1,1,1,3,3,3-hexafluoropropane (R236fa), 1,1,1,3,3-pentafluoropropane (R245fa), and 1,1,1,3,3-pentafluorobutane (R365mfc), or mixtures of two or more thereof.

Although the saturated fluorinated hydrocarbon refrigerant is appropriately selected from the above depending on the application and required performance, preferred examples thereof include R32 alone; R23 alone; R134a alone; R125 alone; a mixture of R134a/R32=60 to 80% by mass/40 to 20% by mass; a mixture of R32/R125=40 to 70% by mass/60 to 30% by mass; a mixture of R125/R143a=40 to 60% by mass/60 to 40% by mass; a mixture of R134a/R32/R125=60% by mass/30% by mass/10% by mass; a mixture of R134a/R32/R125=40 to 70% by mass/15 to 35% by mass/5 to 40% by mass; a mixture of R125/R134a/R143a=35 to 55% by mass/1 to 15% by mass/40 to 60% by mass. More specifically, it is possible to use a mixture of R134a/R32=70/30% by mass; a mixture of R32/R125=60/40% by mass; a mixture of R32/R125=50/50% by mass (R410A); a mixture of R32/R125=45/55% by mass (R410B); a mixture of R125/R143a=50/50% by mass (R507C); a mixture of R32/R125/R134a=30/10/60% by mass; a mixture of R32/R125/R134a=23/25/52% by mass (R407C); a mixture of R32/R125/R134a=25/15/60% by mass (R407E); a mixture of R125/R134a/R143a=44/4/52% by mass (R404A) and the like.

The unsaturated fluorinated hydrocarbon (HFO) refrigerant is preferably fluoropropene, and more preferably fluoropropene which has 3 to 5 fluorine atoms. Specifically, it is preferable that the unsaturated fluorinated hydrocarbon refrigerant be any one or a mixture of two or more of 1,2,3,3,3-pentafluoropropene (HFO-1225ye) and 1,3,3,3-tetrafluoropropene (HFO-1234ze), 2,3,3,3-tetrafluoropropene (HFO-1234yf), 1,2,3,3-tetrafluoropropene (HFO-1234ye), and 3,3,3-trifluoropropene (HFO-1243zf). From the viewpoint of the physical characteristics of the refrigerant, it is preferable that the amount is one or two or more selected from HFO-1225ye, HFO-1234ze and HFO-1234yf.

The hydrocarbon refrigerant is preferably a hydrocarbon having 1 to 5 carbon atoms, and more preferably a hydrocarbon having 2 to 4 carbon atoms. Specific examples of the hydrocarbon include methane, ethylene, ethane, propylene, propane (R290), cyclopropane, normal butane, isobutane, cyclobutane, methylcyclopropane, 2-methylbutane, normal pentane, or mixtures of two or more thereof. Among these, those which are gaseous at 25° C. and 1 atm are preferably used, and propane, normal butane, isobutane, 2-methylbutane or a mixture thereof is preferable.

The content of the refrigerating machine oil in the working fluid composition for a refrigerating machine may be preferably 1 to 500 parts by mass, more preferably 2 to 400 parts by mass with respect to 100 parts by mass of the refrigerant.

The refrigerating machine oil and the working fluid composition for a refrigerating machine according to the present embodiment are suitably used for an air conditioner having a reciprocating or rotary hermetic compressor, a refrigerator, an open or hermetic car air conditioner, a dehumidifier, a water heater, a freezer, a freezing and refrigerating warehouse, an automatic vending machine, a showcase, a refrigerating machine such as a chemical plant, a refrigerating machine having a centrifugal compressor, and the like.

EXAMPLES

Hereinafter, the present invention will be described in more detail based on Examples, but the present invention is not limited to Examples.

The refrigerating machine oil was prepared by blending the base oil shown below and the following various additives so as to have the compositions shown in Table 1 (% by mass based on the total amount of refrigerating machine oil). In addition, the refrigerating machine oil was prepared by adding a base oil to a mixture of additives obtained by mixing the above various additives.

(Base Oil)

A1: mixed base oil of the following (a1) and (a2) (mixing ratio (mass ratio): (a1)/(a2)=70/30)

(a1) polyol ester of pentaerythritol and a mixed fatty acid of 2-methylpropanoic acid/3,5,5-trimethylhexanoic acid (mixing ratio (mass ratio): 60/40) (kinematic viscosity at 40° C.: 46 $mm^2/s$, kinematic viscosity at 100° C.: 6.3 $mm^2/s$)

(a2) complex ester (kinematic viscosity at 40° C.: 146 $mm^2/s$, viscosity index: 140) obtained by further reacting 3,5,5-trimethylhexanol (1.1 mol) with an ester intermediate obtained by reacting neopentyl glycol (1 mol) and 1,4-butanediol (0.2 mol) with adipic acid (1.5 mol), and removing remaining unreacted materials by distillation.

(Phosphonic Acid Diester)

B1: dilauryl hydrogen phosphite

B2: di(2-ethylhexyl) hydrogen phosphite

B3: dioleyl hydrogen phosphite (Amine Compound)

C1: di(2-ethylhexyl)amine

C2: oleylamine (Other Additives)

Package additives containing phenol-based antioxidant, phosphorus-based antiwear agent, and epoxy-based acid scavenger In Example 1, the phosphonic acid diester B1 and the amine compound C1 and other additives were added to the base oil A1 and mixed at 60° C. for 60 minutes to obtain a refrigerating machine oil. Further, it was confirmed by NMR analysis that an amine salt of phosphonic acid and/or an amine salt of phosphonic acid monoester was produced in the refrigerating machine oil. $^{31}$P-NMR charts showing that an amine salt of phosphonic acid and/or an amine salt of phosphonic acid monoester are produced in the refrigeration machine oil are shown in FIGS. 1 and 2.

Figure 2:
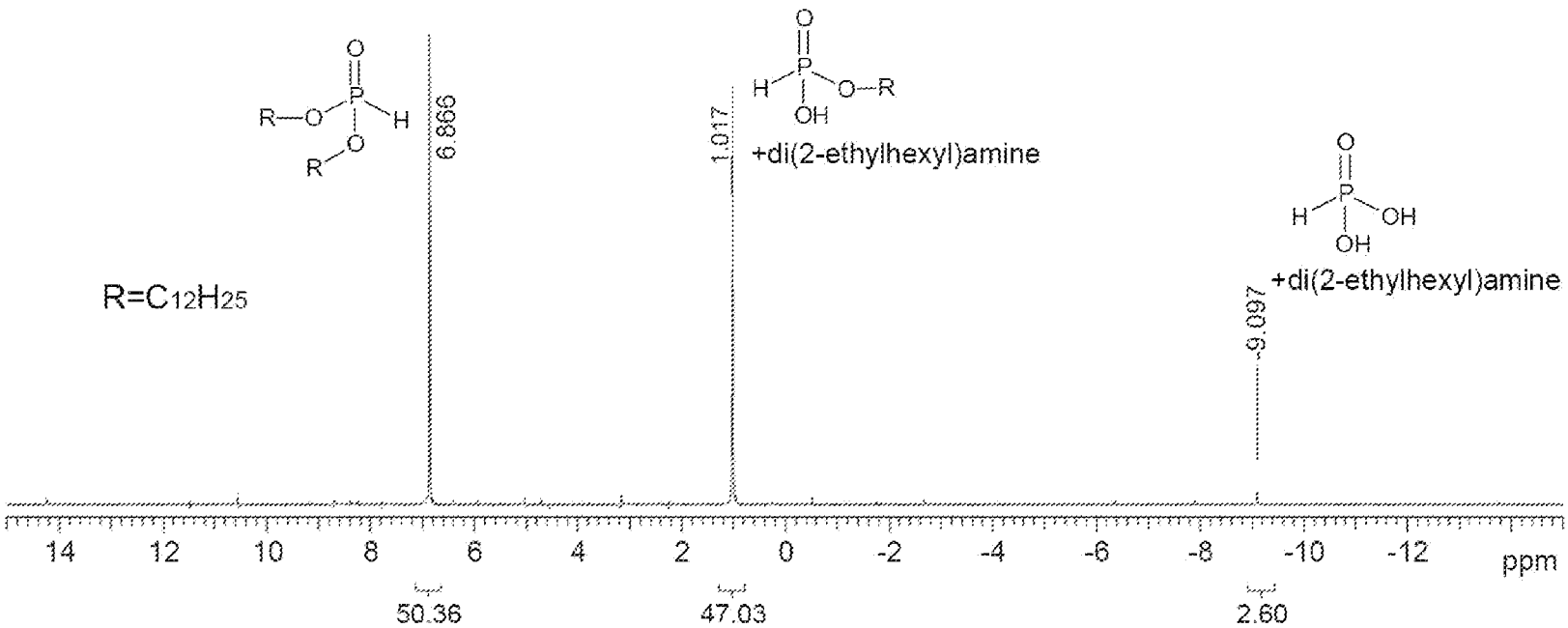
FIG. 2 is a $^{31}$P-NMR chart showing that amine salts of phosphonic acid and phosphonic acid monoester are produced by the addition of an amine compound.

FIG. 1 is a $^{31}$P-NMR chart measured by adding phosphonic acid diester B1 to a solvent (dibenzene), and it can be seen that phosphonic acid diester, phosphonic acid monoester and phosphonic acid are present. Further, as shown in FIG. 2, it was inferred that the amine salts of the above phosphonic acid monoester and phosphonic acid were produced by the amine compound C1. Similarly, for the refrigerating machine oil of Example 1, peaks of these amine salts were confirmed on the $^{31}$P-NMR chart.

For each of the refrigerating machine oils of Examples 1 to 5 and Comparative Examples 1 to 3, the antiwear property was evaluated on the preparation day of the refrigerating machine oil and after 7 days in a constant temperature bath at 60° C. from the preparation date by the procedure shown below. The results are shown in Table 1. As for the refrigerating machine oil of Comparative Example 2, the antiwear property effect was not obtained as of the day of adjustment, so the antiwear property after 7 days had not been evaluated.

(Evaluation of Antiwear Property)

A friction test device in which a vane (SKH-51) for the upper test piece and a disk (SNCM220 HRC50) for the lower test piece were used was mounted inside a closed container. Into a friction test site, 600 g of each refrigerating machine oil was introduced, the inside of the system was evacuated, and then 100 g of R32 refrigerant was introduced and heated. After setting the temperature in the closed container to 110° C., an antiwear property test was performed under a load of 1000 N and a rotation speed of 750 rpm, and wear amounts of the vane and the disc after the test for 60 minutes were measured. The smaller value of the wear amounts means better antiwear property.

TABLE 1

| | | Example 1 | Comparative Example 1 | Comparative Example 2 | Example 2 | Example 3 | Example 4 | Example 5 | Comparative Example 3 |
|---|---|---|---|---|---|---|---|---|---|
| Composition (% by mass) | A1 | balance | balance | balance | balance | balance | balance | balance | balance |
| | B1 | 0.1 | 0.1 | — | — | — | 0.1 | — | — |
| | B2 | — | — | — | 0.1 | 0.1 | — | — | — |
| | B3 | — | — | — | — | — | — | 0.3 | 0.5 |
| | C1 | 0.04 | — | 0.04 | 0.01 | — | — | 0.004 | — |
| | C2 | — | — | — | — | 0.015 | 0.04 | — | — |
| | other additives | 2.7 | 2.7 | 2.7 | 2.7 | 2.7 | 2.7 | 2.7 | 2.7 |
| On preparation day | Wear amount of vane (μm) | 0.9 | 0.8 | 2.7 | 1 | 0.6 | 0.8 | 0.9 | 0.9 |
| | Wear amount of disc (μm) | 0.35 | 0.3 | 1.84 | 0.19 | 0.49 | 0.38 | 0.25 | 0.35 |
| After 7 days | Wear amount of vane (μm) | 0.8 | 3.5 | none performed | 1.04 | 0.63 | 0.86 | 0.95 | 4 |
| | Wear amount of disc (μm) | 0.25 | 2.26 | none performed | 0.21 | 0.51 | 0.41 | 0.26 | 3.1 |

The invention claimed is:

1. A refrigerating machine oil comprising:

a lubricating base oil; and at least one selected from the group consisting of an amine salt of phosphonic acid and an amine salt of phosphonic acid monoester, wherein the phosphonic acid is represented by the following formula (1):

(1)

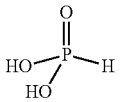

and the phosphonic acid monoester is represented by the following formula (2):

(2)

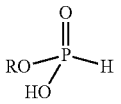

wherein R represents a hydrocarbon group.

2. A method for producing a refrigerating machine oil, comprising adding at least one selected from the group consisting of an amine salt of phosphonic acid and an amine salt of phosphonic acid monoester to a lubricating base oil or an oil composition comprising a lubricating base oil, wherein the phosphonic acid is represented by the following formula (1):

(1)

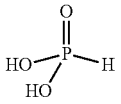

and the phosphonic acid monoester is represented by the following formula (2):

(2)

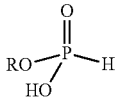

wherein R represents a hydrocarbon group.

3. A method for producing a refrigerating machine oil, comprising adding a phosphonic acid diester and an amine compound to a lubricating base oil or an oil composition comprising a lubricating base oil, wherein the phosphonic acid is represented by the following formula (3):

(3)

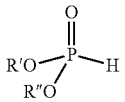

wherein R' and R" each represents a hydrocarbon group.

4. The refrigerating machine oil according to claim 1, wherein the amine salt of phosphonic acid is a salt of a compound represented by the following formula (1) and an alkyl- or alkenyl-amine having one or two alkyl or alkenyl groups having 1 to 20 carbon atoms (1)

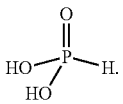

5. The refrigerating machine oil according to claim 1, wherein the amine salt of phosphonic acid monoester is a salt of a compound represented by the following formula (2) and an alkyl- or alkenyl-amine having one or two alkyl or alkenyl groups having 1 to 20 carbon atoms:

(2)

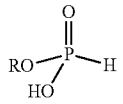

wherein R represents an alkyl or alkenyl group having 2 to 18 carbon atoms.

6. The refrigerating machine oil according to claim 1, wherein a content of the at least one selected from the group consisting of
an amine salt of phosphonic acid and
an amine salt of phosphonic acid monoester
is 0.0001 to 1% by mass based on the total amount of refrigerating machine oil.

7. The refrigerating machine oil according to claim 1, wherein the lubricating base oil comprises an ester.

8. The refrigerating machine oil according to claim 1, wherein the lubricating base oil comprises at least one selected from the group consisting of a polyol ester and a complex ester.

9. The refrigerating machine oil according to claim 1, wherein the lubricating base oil comprises a polyol ester and a complex ester.

* * * * *